United States Patent [19]

Cornell et al.

[11] 4,175,691

[45] Nov. 27, 1979

[54] STACKABLE CARTON FOR PERISHABLE COMMODITIES

[75] Inventors: William F. Cornell, Fresno; John P. Vear, Salinas; E. Anthony Pascuzzi, El Toro, all of Calif.

[73] Assignee: Champion International Corporation, Stamford, Conn.

[21] Appl. No.: 936,612

[22] Filed: Aug. 24, 1978

[51] Int. Cl.[2] ..... B65D 13/00; B65D 5/32

[52] U.S. Cl. ..... 229/36; 229/23 R; 229/6 A

[58] Field of Search ..... 229/34 R, 36, 23 R, 229/6 A

[56] References Cited

U.S. PATENT DOCUMENTS

| | | | |
|---|---|---|---|
| 1,894,226 | 1/1933 | Ross | 229/36 |
| 3,395,850 | 8/1968 | Kotowick | 229/36 |
| 3,937,390 | 2/1976 | Winkler | 229/23 R |
| 3,998,379 | 12/1976 | Myers et al. | 229/23 R |
| 4,046,309 | 9/1977 | Poggiali | 229/36 X |
| 4,084,740 | 4/1978 | Lorenz | 229/23 R |
| 4,103,819 | 8/1978 | Muise | 229/6 A X |
| 4,126,225 | 11/1978 | Hyland | 229/6 A X |
| 4,134,533 | 1/1979 | Heavner | 229/34 R |

*Primary Examiner*—Davis T. Moorhead

*Attorney, Agent, or Firm*—Evelyn M. Sommer

[57] ABSTRACT

A stackable carton particularly suited for packing fresh fruits and vegetables includes a tray with a rectangular floor panel and vertical side walls. The shorter side walls include end cover flaps with openings adjacent the upper edge. The floor panel includes a pair of openings in vertical alignment with openings in the end cover flap. Side cover flaps extend from the upper edges of the longer side walls. A generally rectangular stacking panel is fitted into each end of the tray with upwardly extending tabs which protrude through the openings in the end cover flaps. Each stacking panel also includes a pair of recesses at its lower edge which are aligned with openings in the rectangular floor panel of the tray. The trays can be vertically stacked with the openings in the floor of one tray being aligned with the protruding tabs at the upper surface of a lower tray.

12 Claims, 9 Drawing Figures

STACKABLE CARTON FOR PERISHABLE COMMODITIES

BACKGROUND OF THE INVENTION

The present invention relates to cartons and more particularly to a stackable carton particularly suitable for holding perishable commodities.

Growers of fruits and vegetables have traditionally used wooden boxes for storage and shipment of their products. Wooden boxes can be readily packed either in the field or at packing sheds and stand up well during short term or long term storage. Moreover, such boxes can be easily palletized and shipped.

Wooden boxes do, however, have the disadvantage that they are somewhat expensive to make both because of the cost of raw materials and because of the labor costs which must be incurred in making such boxes. Moreover, wooden boxes must be manufactured in their erected form and shipped fully erected to the grower before they are ever put into use. Since the boxes are bulky even when empty, the costs of shipping them to the user in quantity are not insignificant.

Paper materials, such as corrugated, are less expensive than wood and can be readily formed into erected cartons which can be shipped to a user in a collapsed condition to save freight costs. However, corrugated cartons have not been widely accepted by growers of fruit and vegetables because of concerns that such cartons may be more easily degraded by moisture than wooden boxes and because it is thought that cardboard cartons do not stack as well as wooden boxes of the same size.

SUMMARY OF THE INVENTION

The present invention overcomes certain problems which have delayed the acceptance of corrugated cartons by the fruit and vegetable industry. A carton constructed in accordance with the present invention may be readily stacked and may be treated with wax to inhibit degradation under high moisture conditions.

A carton made in accordance with the present invention includes a generally rectangular floor panel having openings at opposite edges thereof. First and second side wall panels extend upright from opposite edges of the floor panel. Each of the side wall panels has a pair of side wall flaps at its opposite ends as well as a side cover flap which extends from the free side of the side wall panel. The carton further includes first and second end wall panels extending upright from the remaining two sides of the rectangular floor panel. Each of the end wall panels has an end cover flap with at least one opening vertically aligned with one of the openings in the floor panel. A stacking panel is fitted into the end of the tray. Each stacking panel has at least one tab which protrudes upward through one of the openings in the end cover flap and a recess which is aligned with an opening through the generally rectangular floor panel.

DESCRIPTION OF THE DRAWINGS

While the specification concludes with claims particularly pointing out and distinctly claiming that which is regarded as the present invention, details of a preferred embodiment of the invention may be more readily ascertained from the following detailed description when read in conjunction with the accompanying drawings wherein:

DETAILED DESCRIPTION

Figure 1:
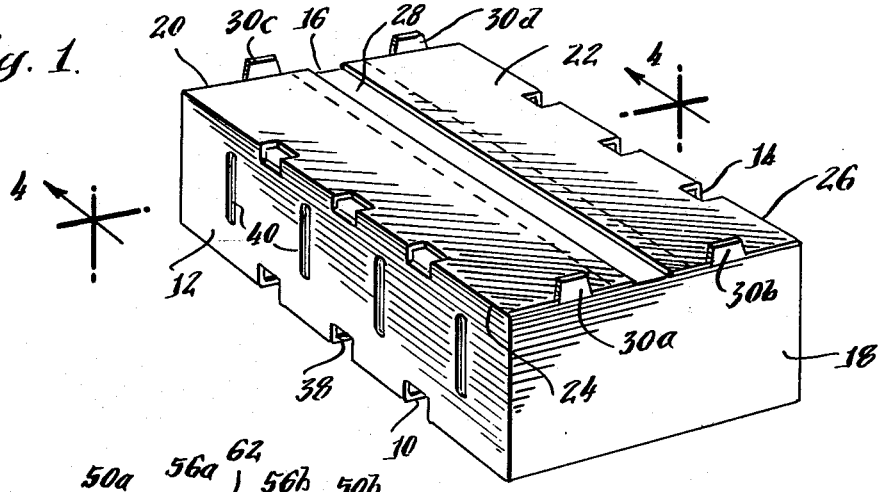
FIG. 1 is a perspective view of an erected, closed carton constructed in accordance with the present invention.

Referring to FIG. 1, a carton incorporating the present invention has rectangular floor panel 10 and upright side wall panels 12 and 14. The remaining two sides of the carton are formed by end wall panels 16 and 18. Side cover flaps 20 and 22 extend from fold lines 24 and 26 defining the upper edge of the side wall panels 12 and 14, respectively. In a preferred embodiment of the invention, each of the side cover flaps has a width that is somewhat less than half the width of the carton so that a gap 28 exists between the outer edges of the side cover flaps. As will be explained in more detail later, the end edges of the side cover flaps 20 and 22 are notched to receive upwardly-extending tabs **30*a*, 30*b*, 30*c* and 30*d* at the upper edges of first and second stacking panels. The stacking panels will also be described in more detail later. Each of the end wall panels 16 and 18 carries an end cover flap 32 and 34, respectively. As will also be described in more detail later, the end cover flaps are perforated to receive the stacking tabs 30*a*–30*d* as well as lock tabs formed at opposite ends of the side cover flaps 20 and 22**.

The carton is ventilated by a series of openings, such as opening 36, along the upper edge of each side wall panel, by another series of openings, such as opening 38, along the lower edge of each side wall panel, and by spaced vertical slots, such as slot 40, in the body of each side wall panel.

Figure 2:
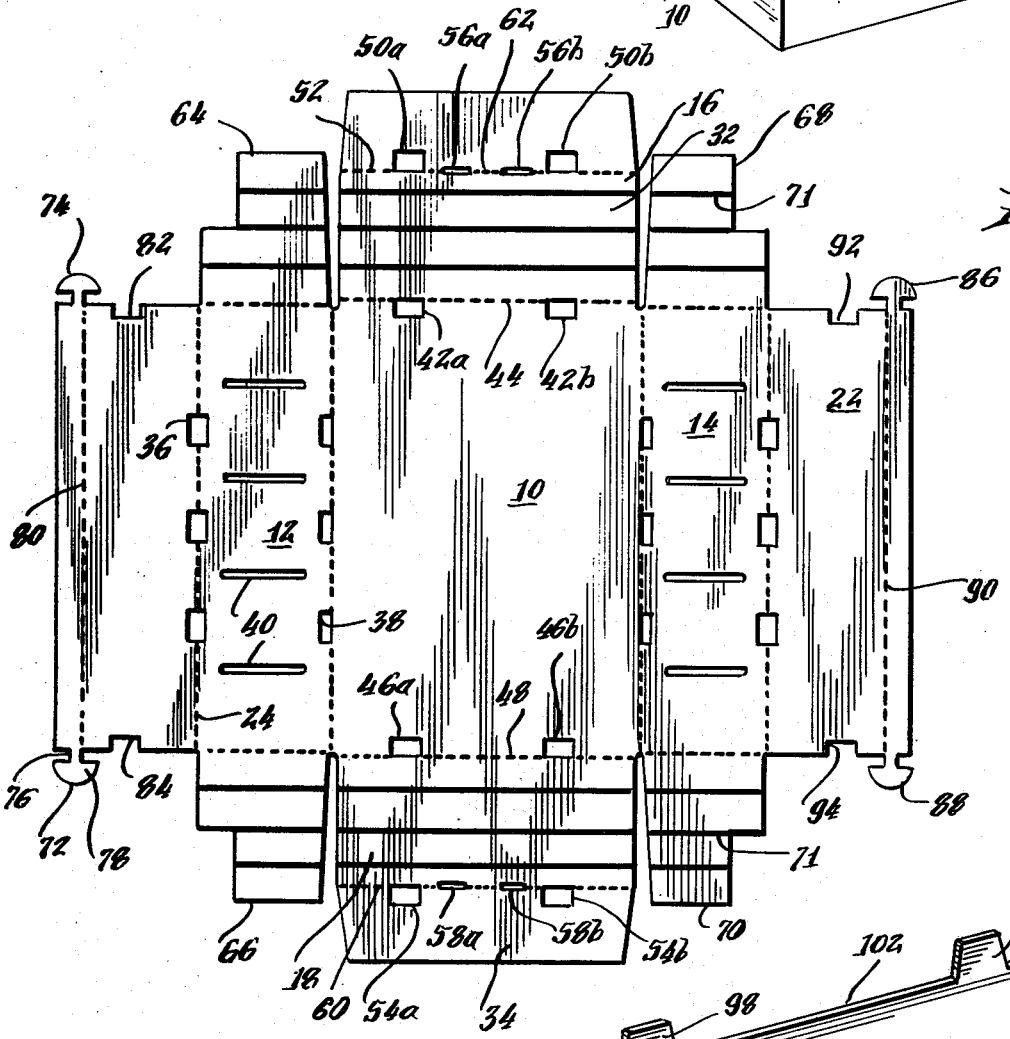
FIG. 2 is a plan view of a one piece blank which may be erected to form the carton of FIG. 1.

The carton described in part above can be erected from a blank shown in FIG. 2. In referring to that figure and to subsequent figures, the same numerals are used to identify the same parts.

The rectangular floor panel 10 has a first pair of openings **42*a* and 42*b* adjacent a fold line 44 defining one end of the panel 10. Similar rectangular openings 46*a* and 46*b* are formed through panel 10 at the opposite end edge 48. Rectangular openings 50*a* and 50*b* exist in end cover flap 32 at a fold line 52. A similar pair of rectangular openings 54*a* and 54*b* exist in the opposite end cover flap 34. In the erected carton, each of these rectangular openings is vertically aligned with one of the openings in the floor panel 10**.

Smaller rectangular openings **56*a* and 56*b* are formed along fold line 52 while similar openings 58*a* and 58*b* are formed along the fold line 60 dividing end cover flap 34 from end wall panel 18. The carton material is slit at the inner end of each of the small rectangular openings. For example, a short slit 62** extends parallel to the fold line 52 from rectangular opening 56*a*. In the erected carton, the openings 56*a*, 56*b*, 58*a* and 58*b* are used in conjunction with locking tabs (to be described) in order to hold the side cover flaps 20 and 22 in their closed positions parallel to the floor panel 10.

Side wall flaps 64 and 66 extend from the upper and lower edges, respectively, of the side wall panel 12. Substantially identical side wall flaps 68 and 70 extend from the upper and lower edges, respectively, of the opposite side wall panel 14.

End wall panels 16 and 18 and side wall flaps 64, 66, 68, and 70 are covered with several strips 71 of a suitable adhesive, which can be applied in a single pass through a conventional adhesive applicator device. Such a device may be located at the blank manufacturing facility but is preferably located at or near the growers' locations to allow the cartons to be shipped and stored flat until they are to be used.

Each of the side cover flaps 20 and 22 includes a pair of locking tabs. More specifically, side cover flap 20 includes generally semicircular locking tabs 72 and 74 at its opposite ends. The diametral or straight side of each locking tab is parallel to the adjacent edge of the side cover flap. Referring specifically to locking tab 72, a material bridge 76 connects the semicircular body 78 of the tab to the side cover flap 20. The bridge 76 is eccentric; that is, closer to one end of the diametral side of body 78 than to the other. A score line 80 extends along the outer edge of the side cover flap 20. The score line is aligned with one edge of the bridge portions of each of the locking tabs 72 and 74. The side cover flap 20 includes generally rectangular notches 82 and 84 at its upper and lower edges, respectively.

The side cover flap 22 is a mirror image of side cover flap 20 including first and second locking tabs 86 and 88, a score line 90 parallel to the outer edge of flap 22 and generally rectangular notches 92 and 94 at the upper and lower edges, respectively.

To erect a carton or tray from the blank shown in FIG. 2, the side wall flaps 64, 66, 68 and 70 are bent upwardly relative to the side wall panels 12 and 14. The side wall panels 12 and 14 are then pivoted about the fold lines defining their boundaries with floor panel 10 to bring the side walls 12 and 14 into a generally upright position. End wall panels 16 and 18 are folded upright bringing their adhesive-coated areas into contact with the uncoated surfaces of the side wall flaps 64 and 68 at one end and flaps 66 and 70 at the other end. The four side walls of the tray are secured in their upright positions by the adhering surfaces of the end wall panels and side wall flaps.

Figure 3:
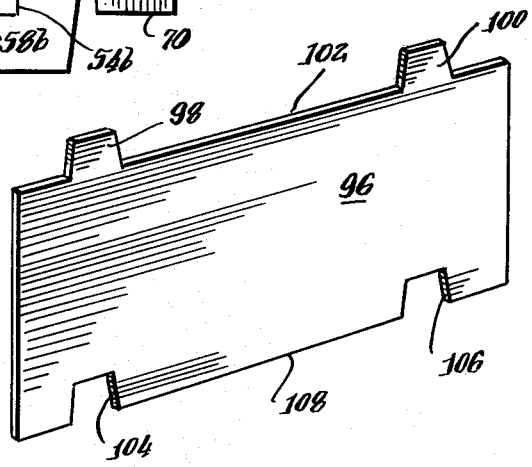
FIG. 3 is a perspective view of a preferred embodiment of stacking panel used in the erected carton.

The carton described thus far is used in combination with generally rectangular stacking panels, a preferred embodiment of one such panel being shown in FIG. 3. Each stacking panel includes a body portion 96 which is slightly smaller in size than an end wall panel of the carton. A pair of generally trapezoidal tabs 98 and 100 project upwardly from an upper edge 102 of the stacking panel. Generally trapezoidal recesses 104 and 106 are provided at the lower edge 108 of the stacking panel. Each recess is aligned with one of the protruding tabs.

A stacking panel such as that described above is inserted into each end of the partially-erected carton, where it is held in place by the adhesive coated areas on the side wall flaps. The recesses at the lower edge of each stacking panel are aligned with the generally rectangular openings at the edges of floor panel 10.

When erected to the point described, the carton is ready to be packed with fruits, vegetables or other perishable commodities. After packing has been completed, the end cover flaps 32 and 34 are bent inwardly until generally parallel to the floor panel 10. The tabs at the upper edges of each of the stacking panels pass through the rectangular openings 50*a*, 50*b*, 54*a*, and 54*b* in the end cover flaps.

The locking tabs 72, 74, 86 and 88 are bent to right angles relative to the surfaces of side cover flaps 20 and 22. The side cover flaps are then folded about the fold lines 24 and 26 to bring the downwardly-extending locking tabs toward the small rectangular openings 56*a*, 56*b* 58*a* and 58*b* at the upper edges of the carton end walls. By folding the edges of the side cover flaps about the fold lines 80 and 90 in a direction away from the floor panel 10, the locking tabs can be maneuvered through the small rectangular openings to lock the side cover flaps in a closed position parallel to the floor panel 10.

Figure 4:
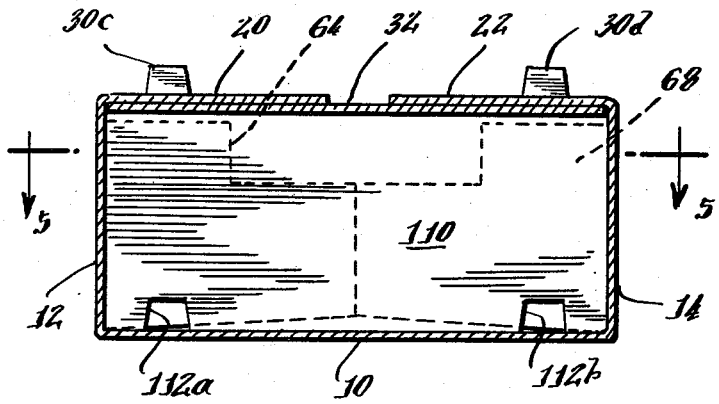
FIG. 4 is a cross sectional view taken along lines 4—4 of FIG. 1 showing the interior end wall of the carton.

FIG. 4 is a cross sectional view illustrating the multiple-thickness end wall assembly in each of the cartons. It will be seen that the stacking panel 110 having tabs 30*c* and 30*d* occupies substantially the entire end area of the carton. The complementary recesses 112*a* and 112*b* are aligned with openings (not visible) in the floor panel 10.

Figure 5:
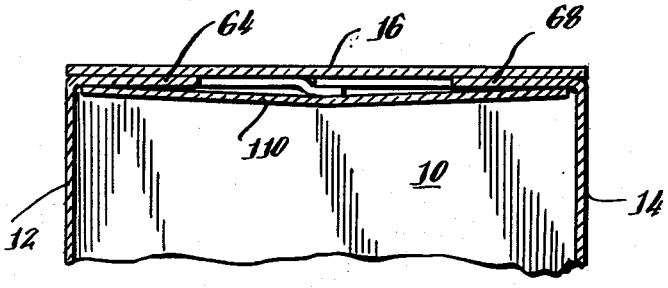
FIG. 5 is a cross sectional view taken along lines 5—5 of FIG. 4 showing the multiple-thickness end wall.

FIG. 5 is a top view showing the various thicknesses in the end wall assembly. It will be seen that the side wall flaps 64 and 68 are sandwiched between the end wall 16 and stacking panel 110.

Figure 6:
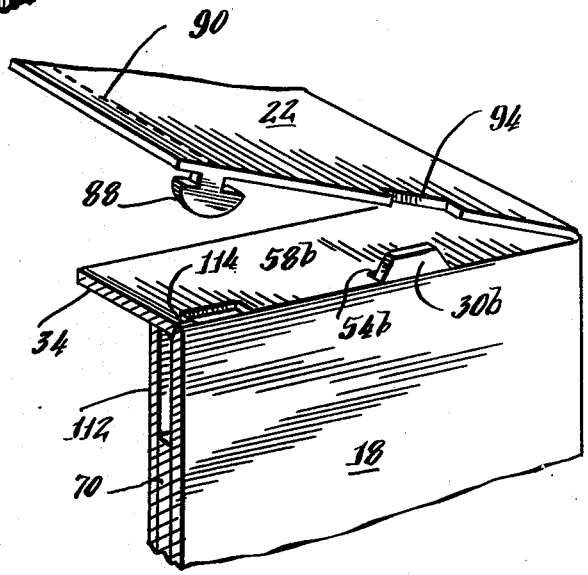
FIG. 6 is an enlarged perspective view illustrating a preferred form of locking tab.

FIG. 6 shows the side cover panel 22 in its nearly closed position. The semicircular locking tab 88 is bent at right angles to the major surface of side cover flap 22. When the outer edge of the side cover flap 22 is bent about score line 90, the semicircular tab 88 can be inserted into the small rectangular opening 58*b* in end cover flap 34. A slit 114 at the inner edge of rectangular opening 58*b* allows the flap material to deform sufficiently to pass semicircular locking tab 88. One tab 30*b* on a stacking panel 112 extends upwardly through opening 54*b* in flap 34. Because the edge of panel 22 is notched at 94, the tab 30*b* can project above the upper surface of the carton.

Figure 7:
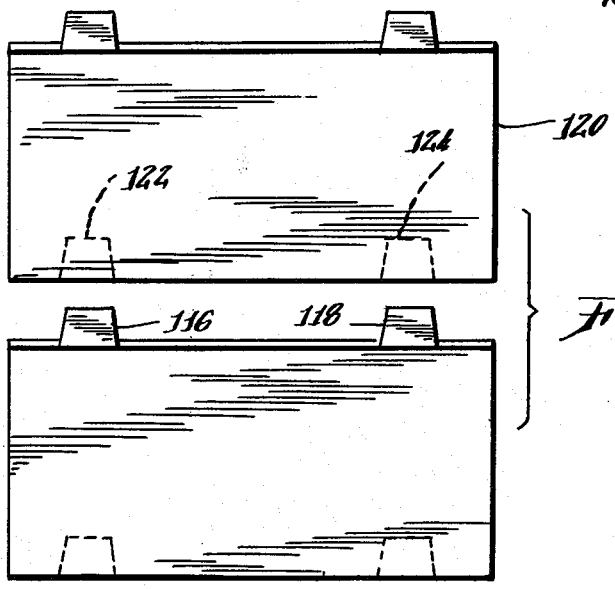
FIG. 7 is an elevational view showing the stacking of two cartons incorporating the present invention.

Cartons of the type described are stacked as shown in FIG. 7 with tabs 116 and 118 on a lower carton being received through openings (not shown) in the floor panel of the next carton 120. The tabs fit into the trapezoidal recesses 122 and 124 formed in the stacking panel contained within upper carton 120. The interlocking stacking panels prevent the stacked cartons from shifting in any direction while the tapered, trapezoidal shapes of the tabs and recesses make it easier to align the cartons when forming the stacks.

If the cartons are to be used in high moisture environments, wax-saturated corrugated material may be used for stacking panels to enhance the stacking strength of the cartons. The edges of the carton blank may also be wax impregnated to enhance performance in high moisture environments.

The blank and carton described in the foregoing material is particularly suitable for use in field packing operations since a field worker can pack and close the carton without the use of machinery. The closed cartons can be stacked on the truck or wagon used to haul them from the fields.

Figure 8:
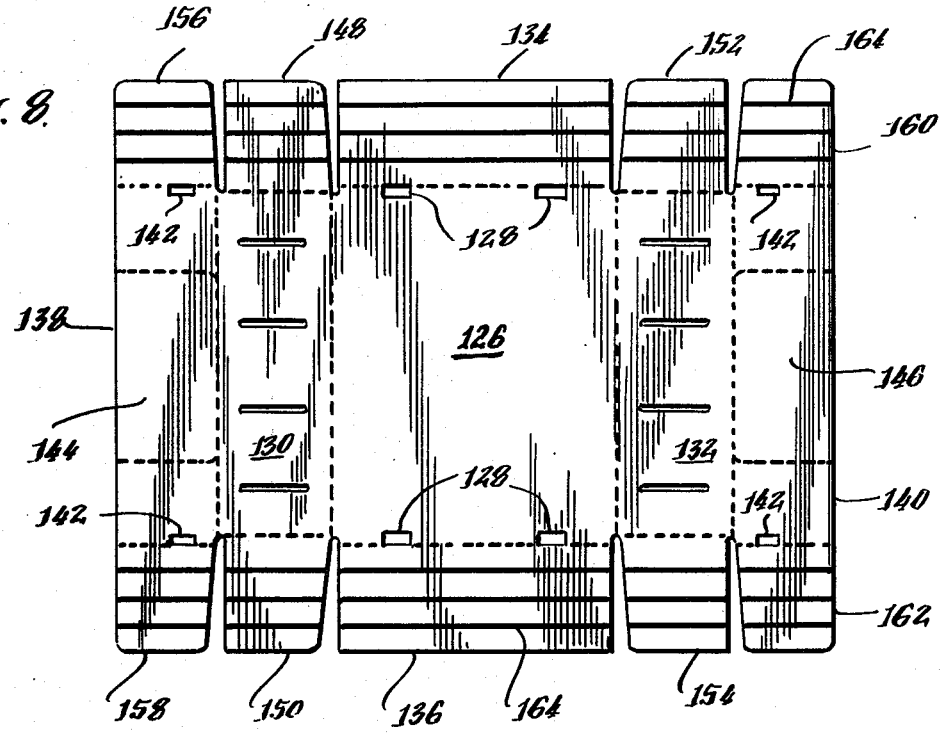
FIG. 8 is a plan view of a blank which may be erected to form an alternate embodiment.
Figure 9:
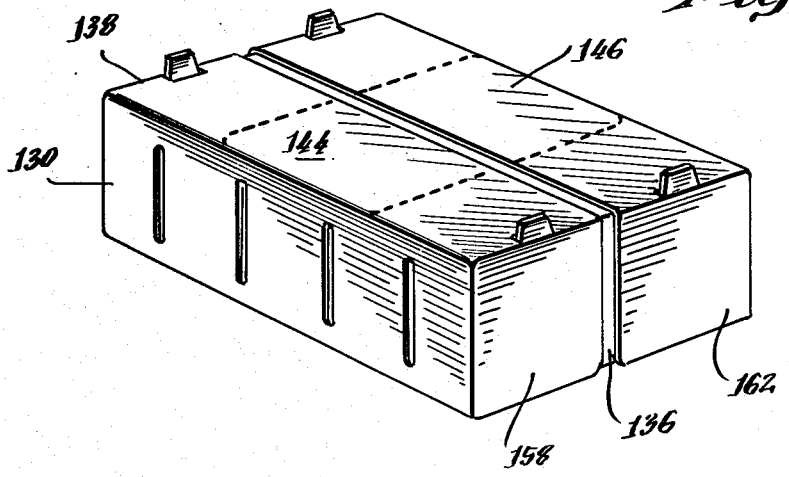
FIG. 9 is a perspective view of a carton erected from the blank of FIG. 8.

Certain types of produce are not field packed. Such produce is first transported in bulk to packing sheds where it may be cleaned and graded as to size, quantity or the like. Such produce is then packed into cartons at the packing shed. A blank for making a carton particularly suitable for shed packing operations is shown in FIG. 8. The blank includes a rectangular floor panel 126 with openings 128 at its upper and lower edges, vented side wall panels 130 and 132, generally rectangular end wall panels 134 and 136, and cover flaps 138 and 140. The cover flaps 138 and 140 include small opening 142 which are vertically aligned with the openings 128 in the erected carton. Cover flaps 138 and 140 further include central panels 144 and 146 having perforated edges.

The side wall panel 130 includes a pair of side wall flaps 148 and 150 while side wall panel 132 includes similar flaps 152 and 154. This embodiment of the carton does not include the locking tabs of the previously described embodiment but instead has cover-locking flaps 156 and 158 extending from opposite ends of cover flap 138 and similar cover-locking flaps 160–162 at opposite ends of cover flap 140.

The end wall panels, side wall flaps and cover-locking flaps carry several strips 164 of suitable adhesive, preferably applied in a single pass through a conventional adhesive applicator device.

A carton is erected from the blank of FIG. 8 in much the same manner as a carton is erected from the blank of FIG. 2. That is, the side wall panels 130 and 132 are bent upwardly and the side wall flaps 148, 150, 152, and 154 are bent inwardly to position them along the fold lines defining the upper and lower edges of the floor panel 126.

The end wall panels 134 and 136 are then bent upwardly or into contact with the non-coated surfaces of the side wall flaps. The end wall panels and side wall flaps are bonded together by the adhesive strips on the end wall panels. Stacking panels of the type previously described with reference to FIG. 3 are inserted into the carton ends and held there by the adhesive strips on the side wall flaps. After the carton is loaded, the cover flaps 138 and 140 are bent inwardly. The cover-locking flaps 156, 158, 160 and 162 are bent downwardly into contact with the outer surfaces of the end wall panels 134 and 136. The adhesive strips on the cover-locking flaps secures those flaps to the end wall panels to lock the cover flaps in place. Closure apparatus would probably be used to bend the cover-locking flaps into place and to apply the heat and/or pressure needed to set the adhesive.

One advantage of this embodiment is that the end walls of the carton are reinforced by the extra layer of material in the cover-locking flaps, enhancing the "stackability" of the carton.

The panels 144 and 146 in the cover flaps can be peeled back to permit the contents of the carton to be inspected or removed by a buyer.

While there has been described what is believed to be a preferred embodiment of the invention, variations and modifications therein will occur to those skilled in the art once they become acquainted with the basic concepts of the invention. Therefore, it is intended that the appended claims shall be construed to include all such variations and modifications as fall within the true spirit and scope of the invention.

What is claimed is:

1. A stackable storage and shipping tray comprising:

a generally rectangular floor panel having openings at opposite edges thereof;

first and second side wall panels extending generally upright from opposite edges of said floor panel, each of said side wall panels including side wall flaps extending from opposite ends thereof and a side cover flap extending from the free side thereof, each said side cover flap including recesses adjacent its side edges;

first and second end wall panels extending generally upright from the remaining opposite edges of said rectangular floor panel, with the inner surface of each said end wall panel being adhesively connected to the outer surface of the associated side wall flaps of said side wall; and first and second stacking panels, each having at least one tab extending upwardly from an upper edge and at least one recess at its lower edge in vertical alignment with said tab, with the outer surface of each said stacking panel being adhesively connected to the inner surface of the associated side wall flaps of said side wall;

said end wall panels, side wall flaps and stacking panels forming triple-ply adhesively connected end wall assemblies wherein each tab on a stacking panel extends through the recess in one of said side cover flaps and each opening at an edge of said floor panel is aligned with a recess at the lower edge of a stacking panel.

2. A tray as defined in claim 1 wherein each said end wall panel further includes an end cover flap extending from its outer edge and having an opening therethrough vertically aligned with an opening in said floor panel.

3. A tray as defined in claim 1 wherein the tabs on each of said stacking panels is trapezoidal in shape with inwardly tapered sides while the recesses have a complementary configuration.

4. A tray as defined in claim 2 wherein each of said side cover flaps includes first and second locking tabs and each of said end cover flaps includes openings for receiving one of said locking tabs to hold said side cover flap in a closed position parallel to said floor panel.

5. A tray as defined in claim 4 wherein said locking tabs are bent from the plane of said side cover flaps to the plane of said end wall panels before being inserted through the openings in said end cover flap.

6. A tray as defined in claim 4 wherein each of said side cover flaps includes a score line parallel to the outer edge thereof for permitting a portion of said side cover flap to be rotated about the score line when inserting said locking tabs through the openings in said end cover flaps.

7. A tray as defined in claim 4 wherein each of said side wall panels includes at least one opening therein for venting the tray.

8. A tray as defined in claim 1 wherein each of said side cover flaps has cover-locking flaps extending from opposite ends thereof, said cover-locking flaps being adapted to be bonded to said end wall panels through an adhesive layer on one of their facing surfaces.

9. A blank which may be erected into a stackable storage and shipping tray after a single pass through an adhesive applicator device and for use in combination with stacking panels including a tab at one edge and a recess at the opposite edge, wherein the erected tray includes opposed triple-ply adhesively connected end wall assemblies, said blank comprising:

a generally rectangular floor panel;

first and second generally rectangular side wall panels extending from fold lines defining opposite side edges of said floor panel;

first and second generally rectangular side cover flaps extending from fold lines defining the outer edges of said first and second side wall panels, respectively;

first and second pairs of side wall flaps, each flap in each of said pairs extending from a fold line defining an end of one of said side wall panels; and first and second generally rectangular end wall panels extending from opposite end edges of said floor panel;

said floor panel and said side cover flaps having openings therein, said openings being located along lines parallel to the side edges of said floor panel.

10. A one piece blank as defined in claim 9 further including first and second pairs of locking tabs, each tab being connected to one end of one of said side cover flaps by a material bridge portion and comprising a generally semicircular body having its diametral edge of said tab to said side cover flap, said bridge portion being located closer to one end of the diametral edge than to the other end.

11. A one piece blank as defined in claim 9 further including first and second generally trapezoidal end cover flaps extending from fold lines at the outer edges of said first and second end wall panels, respectively, said end cover flaps having openings therein, said openings being disposed such that they are vertically aligned with the openings in said floor panel and said side cover flaps in the erected tray.

12. A one piece blank as defined in claim 9 further including first and second pairs of cover-locking flaps, each flap in each of said pairs extending from one end of one of said side cover flaps.

* * * * *